US009388718B2

(12) United States Patent
Ashraph

(10) Patent No.: US 9,388,718 B2
(45) Date of Patent: Jul. 12, 2016

(54) SYSTEM AND METHOD FOR TUNED EXHAUST

(71) Applicant: Cameron International Corporation, Houston, TX (US)

(72) Inventor: Ken Herman Ashraph, Houston, TX (US)

(73) Assignee: GE Oil & Gas Compression Systems, LLC, Houston, TX (US)

( * ) Notice: Subject to any disclaimer, the term of this patent is extended or adjusted under 35 U.S.C. 154(b) by 0 days.

(21) Appl. No.: 14/227,991

(22) Filed: Mar. 27, 2014

(65) Prior Publication Data

US 2015/0275721 A1 Oct. 1, 2015

(51) Int. Cl.

| | |
|---|---|
| ***F01N 13/08*** | (2010.01) |
| ***F01N 1/08*** | (2006.01) |
| ***F02B 27/06*** | (2006.01) |
| ***F01N 1/16*** | (2006.01) |
| *F01N 13/00* | (2010.01) |
| *F01N 1/02* | (2006.01) |
| *F02B 27/04* | (2006.01) |
| *F01N 3/28* | (2006.01) |
| *F01N 13/18* | (2010.01) |

(52) U.S. Cl.

CPC ..... *F01N 1/089* (2013.01); *F01N 1/165* (2013.01); *F01N 13/08* (2013.01); *F01N 3/2885* (2013.01); *F01N 13/1816* (2013.01); *F01N 2470/02* (2013.01); *F01N 2470/16* (2013.01); *F01N 2470/18* (2013.01); *F01N 2470/20* (2013.01); *F01N 2490/04* (2013.01); *F01N 2490/18* (2013.01)

(58) Field of Classification Search

USPC ..... 181/238, 272, 281, 282, 269, 231, 240; 60/312, 314, 313, 324, 299

See application file for complete search history.

(56) References Cited

U.S. PATENT DOCUMENTS

| | | | | | |
|---|---|---|---|---|---|
| 2,196,920 | A | * | 4/1940 | Hoyle | 181/231 |
| 2,241,010 | A | * | 5/1941 | Chipley | 181/272 |
| 2,287,412 | A | * | 6/1942 | Bourne | 181/272 |
| 2,326,613 | A | * | 8/1943 | Bourne et al. | 181/272 |
| 2,353,036 | A | * | 7/1944 | Hoyle | 181/240 |
| 2,513,229 | A | * | 6/1950 | Bourne et al. | 181/240 |
| 2,829,729 | A | * | 4/1958 | Bourne et al. | 181/272 |
| 3,276,202 | A | | 10/1966 | Wright | |
| 3,462,947 | A | * | 8/1969 | Nowak | 60/314 |
| 3,476,524 | A | | 11/1969 | Burke | |
| 3,647,394 | A | | 3/1972 | Wetch et al. | |

(Continued)

FOREIGN PATENT DOCUMENTS

| | | | | |
|---|---|---|---|---|
| JP | 52018520 A | * | 2/1977 | F01N 3/10 |
| JP | 409158722 | | 6/1997 | |

*Primary Examiner* — Edgardo San Martin

(74) *Attorney, Agent, or Firm* — Fletcher Yoder P.C.

(57) ABSTRACT

A system is provided that includes an exhaust system. The exhaust system includes a first and a second conduit configured to receive an exhaust from an engine having at least two cylinders and configured to operate at a range of less than 600 revolutions per minute. The exhaust system further includes a first chamber configured to receive the exhaust from the first and the second conduits, and a second chamber downstream of the first chamber and fluidly coupled to the first chamber by using a third conduit. The exhaust system additionally includes a third chamber downstream of the second chamber and fluidly coupled to the second chamber by using a fourth and a fifth conduit and an exhaust stack downstream of the third chamber and fluidly coupled to the third chamber.

23 Claims, 6 Drawing Sheets

(56) References Cited

U.S. PATENT DOCUMENTS

| | | | | | |
|---|---|---|---|---|---|
| 3,687,225 | A | * | 8/1972 | Nelson | 181/269 |
| 3,760,900 | A | | 9/1973 | Overcast | |
| 3,775,064 | A | | 11/1973 | Berger et al. | |
| 3,853,201 | A | * | 12/1974 | Smale | 181/265 |
| 3,853,484 | A | | 12/1974 | Sudar et al. | |
| 4,011,922 | A | * | 3/1977 | Goplen | 181/272 |
| 4,037,407 | A | * | 7/1977 | Mizuno et al. | 60/277 |
| 4,064,962 | A | * | 12/1977 | Hunt | 181/272 |
| 4,064,963 | A | * | 12/1977 | Kaan et al. | 181/244 |
| 4,162,904 | A | * | 7/1979 | Clay et al. | 96/381 |
| 4,177,875 | A | | 12/1979 | Kurobe et al. | |
| 4,203,502 | A | * | 5/1980 | Strader | 181/238 |
| 4,203,503 | A | * | 5/1980 | Franco et al. | 181/272 |
| 4,332,307 | A | * | 6/1982 | Ito | 181/256 |
| 4,382,487 | A | * | 5/1983 | Baumann | 181/282 |
| 4,426,844 | A | | 1/1984 | Nakano | |
| 4,487,288 | A | * | 12/1984 | Watanabe et al. | 181/238 |
| 4,851,015 | A | | 7/1989 | Wagner et al. | |
| 4,867,270 | A | | 9/1989 | Wissmann et al. | |
| 4,916,897 | A | | 4/1990 | Hayashi et al. | |
| 4,949,807 | A | * | 8/1990 | Hirata et al. | 181/240 |
| 5,016,438 | A | * | 5/1991 | Harris | 60/299 |
| 5,052,178 | A | | 10/1991 | Clerc et al. | |
| 5,168,132 | A | * | 12/1992 | Beidl et al. | 181/265 |
| 5,212,948 | A | | 5/1993 | Gillingham et al. | |
| 5,248,859 | A | | 9/1993 | Borla | |
| 5,338,903 | A | | 8/1994 | Winberg | |
| 5,435,347 | A | | 7/1995 | Gillingham | |
| 5,612,006 | A | | 3/1997 | Fisk | |
| 5,738,184 | A | | 4/1998 | Masuda et al. | |
| 5,808,245 | A | | 9/1998 | Wiese et al. | |
| 5,809,776 | A | | 9/1998 | Holtemann et al. | |
| 5,857,324 | A | | 1/1999 | Scappatura et al. | |
| 5,866,859 | A | | 2/1999 | Karlsson et al. | |
| 5,902,971 | A | | 5/1999 | Sato et al. | |
| 5,907,135 | A | * | 5/1999 | Hayakawa et al. | 181/282 |
| 5,916,128 | A | | 6/1999 | Garr et al. | |
| 5,921,079 | A | | 7/1999 | Harris | |
| 6,109,026 | A | | 8/2000 | Karlsson et al. | |
| 6,233,926 | B1 | | 5/2001 | Bailey et al. | |
| 6,277,784 | B1 | | 8/2001 | Kruse | |
| 6,315,076 | B1 | | 11/2001 | Bruck et al. | |
| 6,357,227 | B1 | | 3/2002 | Neufert | |
| 6,403,039 | B1 | | 6/2002 | Bruck | |
| 6,588,203 | B2 | | 7/2003 | Hirota et al. | |
| 6,622,482 | B2 | | 9/2003 | Knight et al. | |
| 6,722,124 | B2 | | 4/2004 | Pawson et al. | |
| 6,789,385 | B2 | | 9/2004 | Glover | |
| 6,821,932 | B2 | | 11/2004 | Guinther et al. | |
| 6,823,660 | B2 | | 11/2004 | Minami | |
| 6,874,316 | B2 | | 4/2005 | Nakatani | |
| 6,892,853 | B2 | * | 5/2005 | Cai et al. | 181/249 |
| 6,912,843 | B2 | * | 7/2005 | Hufendiek et al. | 60/282 |
| 6,918,463 | B2 | | 7/2005 | Takahashi et al. | |
| 6,935,105 | B1 | | 8/2005 | Page et al. | |
| 6,935,285 | B2 | | 8/2005 | Yuasa et al. | |
| 6,938,729 | B2 | * | 9/2005 | Worner et al. | 181/254 |
| 7,104,359 | B1 | * | 9/2006 | Zelinski | 181/264 |
| 7,281,606 | B2 | | 10/2007 | Marocco | |
| 7,350,349 | B2 | | 4/2008 | Olofsson | |
| 7,428,947 | B2 | | 9/2008 | Nohl et al. | |
| 7,464,543 | B2 | | 12/2008 | Chrisman et al. | |
| 7,690,194 | B2 | | 4/2010 | Chrisman et al. | |
| 7,713,493 | B2 | | 5/2010 | Bosanec, Jr. et al. | |
| 7,765,799 | B2 | | 8/2010 | Chrisman et al. | |
| 7,818,963 | B2 | | 10/2010 | Chrisman et al. | |
| 7,980,070 | B2 | * | 7/2011 | Mashiko et al. | 60/298 |
| 8,069,660 | B1 | * | 12/2011 | Cone et al. | 60/320 |
| 8,468,813 | B2 | * | 6/2013 | Hill et al. | 60/324 |
| 8,646,260 | B2 | | 2/2014 | Chrisman et al. | |
| 2004/0245044 | A1 | | 12/2004 | Cerrato-Jay et al. | |
| 2007/0245713 | A1 | | 10/2007 | Chrisman et al. | |
| 2008/0053078 | A1 | | 3/2008 | Chrisman et al. | |
| 2008/0072579 | A1 | | 3/2008 | Chrisman et al. | |
| 2014/0208723 | A1 | * | 7/2014 | Baig et al. | 60/295 |

* cited by examiner

SYSTEM AND METHOD FOR TUNED EXHAUST

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Two-stroke (alternatively referred to as two-cycle) engines have been applied in a range of applications. One class of two-stroke engines is the class of engines operating on a normally gaseous hydrocarbon, most commonly natural gas, under lean burn conditions. Such engines are generally large, slow revolutions per minute (RPM) running engines of a stationary design and find application in the driving of rotating and reciprocating equipment, such as compressors and electric generators. The exhaust produced by such engines may result in unwanted noise and include undesirable particles and substances, such as nitrous oxides (NOx). It would be beneficial to reduce the exhaust noise and minimize the exhaust of undesirable particles and substances.

SUMMARY

The systems and methods disclosed herein provide for a combination exhaust silencer tuned and controller to improve noise dampening, scavenging, pollutant capture, and engine efficiency.

In one embodiment, a system is provided. The system includes an exhaust system. The exhaust system includes a first and a second conduit configured to receive an exhaust from an engine having at least two cylinders and configured to operate at a range of less than 600 revolutions per minute. The exhaust system further includes a first chamber configured to receive the exhaust from the first and the second conduits, and a second chamber downstream of the first chamber and fluidly coupled to the first chamber by using a third conduit. The exhaust system additionally includes a third chamber downstream of the second chamber and fluidly coupled to the second chamber by using a fourth and a fifth conduit and an exhaust stack downstream of the third chamber and fluidly coupled to the third chamber.

In another embodiment, an exhaust system is provided. The exhaust system includes a compartment and a first and second plate disposed inside the compartment and defining a first, a second, and a third partition of the compartment. The exhaust system further includes a first and a second conduit fluidly coupled to the first partition and configured to receive an exhaust from an engine having at least two cylinders, the engine configured to operate at a range of less than 600 revolutions per minute; wherein the second partition is disposed downstream of the first partition and is fluidly coupled to the first partition by using a third conduit and the third partition is disposed downstream of the second partition and is fluidly coupled to the second partition by using a fourth conduit/ The exhaust system additionally includes an exhaust stack downstream of the third partition and fluidly coupled to the third partition.

In yet another embodiment, a system is provided. The system includes an exhaust system having a first conduit configured to receive an exhaust from a two-stroke engine configured to operate at a range of less than 600 revolutions per minute. The exhaust system further includes a first chamber configured to receive the exhaust from the first conduit and a second chamber downstream of the first chamber and fluidly coupled to the first chamber by using a second conduit. The exhaust system additionally includes a third chamber downstream of the second chamber and fluidly coupled to the second chamber by using a third conduit and an exhaust stack downstream of the third chamber and fluidly coupled to the third chamber.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skills having the benefit of this disclosure.

Certain exemplary embodiments of the present invention include systems and methods for improving engine operations, particularly 2-stroke natural gas fueled engines. The engine may operate at a slow (revolutions per minute) RPM range, such as between 100-500, 100-750 RPM, 100-1000 RPM, under lean burn conditions and providing power in a range of between 100-400, 100-600, 100-1000 kilowatts (KW). In certain embodiments, a tuned exhaust silencer is provided, suitable for improving air flow while minimizing the exhaust noise and reducing the expelled number of undesired particles and substances, such as nitrous oxides (NOx). Additionally, the tuned exhaust silencer may increase engine efficiency by directing higher pressure exhaust gas in certain ways as detailed below to improve the wave dynamics of the system. The wave dynamics may be timed so as to improve the flow of fresh fuel and air into engine cylinders and to provide for enhanced wave blocking of exhaust port(s), for example, during a compression stroke.

The tuned exhaust described herein may include at least two exhaust ports fluidly coupled to an exhaust shell via exhaust pipes. The exhaust shell may be further divided into two or more shell chambers by using baffle plates and/or perforated pipe. An exhaust stack may include a flow restriction device, such as a butterfly valve, communicatively coupled to a controller suitable for measuring engine operational properties and actuating the restriction device so as to more optimally control exhaust gases leaving the exhaust as well as modifying the wave dynamics of the system. The tuned exhaust further includes certain desired geometries, such as inlet and outlet sizes, diameters, lengths, and locations of exhaust components useful in improving exhaust flow, wave dynamics, and in increasing engine efficiency.

Figure 1:
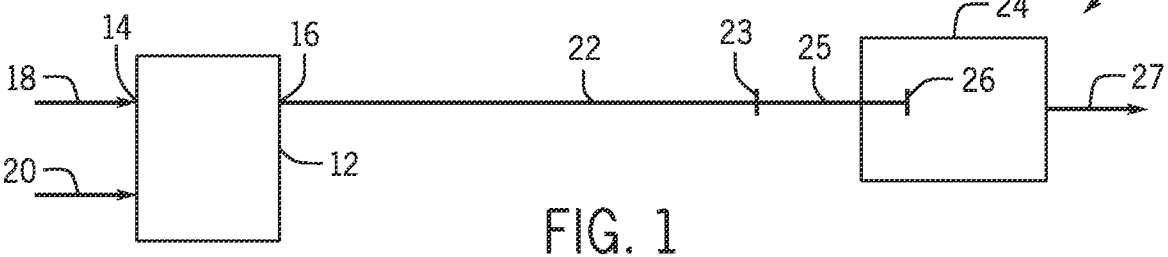
FIG. 1 is a block diagram of embodiments of an internal combustion engine fluidly coupled to a tuned exhaust system.

With the foregoing in mind and referring now to FIG. 1, an embodiment of a stationary internal combustion engine system 10 is shown having from one to four cylinders, with only one cylinder 12 schematically shown. In one embodiment, the engine system 10 may be a two-stroke or two-cycle internal combustion engine. In another embodiment, the engine system 10 may be a four-stroke or four-cycle internal combustion engine. The cylinder 12 has an inlet port 14 and an exhaust port 16. A gaseous hydrocarbon fuel is fed into each cylinder 12 at the appropriate point in the engine's cycle via line 18 in fluid communication with the inlet port 14. A source of lubricating engine oil is provided to the engine via line 20. Other details of the engine have been omitted from FIG. 1 for the sake of clarity. Stationary natural gas fueled 2-stroke engines typically operate at constant speeds in the range of from 100 to 1000 RPM, more typically 250 to 500 RPM.

In operation, a piston reciprocates within each cylinder 12 of the stationary engine. As the piston descends within the cylinder moving away from the cylinder head, it opens the inlet port 14, through which a gas or a mixture of gases is admitted and flows into the cylinder 12. At approximately this time, the cylinder 12 is filled with gases which are products of combustion. In certain designs of engine, a mixture of gaseous fuel and air is admitted into the cylinder 12 through the inlet port 14 also at approximately this time. In some designs of the engine system 10, such as Ajax® engines available from Cameron Co., of Houston, Tex., air is admitted to the cylinder 12 through the inlet port 14. At approximately the same time as when the inlet port 14 is open, the descending piston also uncovers the exhaust port 16, through which burnt gases may leave the cylinder 12 via exhaust pipe 22, to form the exhaust gas of the engine. The fluid movement of freshly charged gases entering the cylinder 12 through the inlet port 14 may serve to assist with forcing the burnt gases out of the exhaust port 16, referred to as "scavenging." The exhaust gases travel through the exhaust pipe 22, into a tuned exhaust inlet 23 of a tuned exhaust 24, through a tuned exhaust inlet pipe 25, through an exhaust outlet 26, and then through the tuned exhaust system 24 and out through an exhaust stack 27. The tuned exhaust system 24 may include vertically or horizontally positionable embodiments. That is the tuned exhaust system 24 may be positioned parallel to the ground (e.g., horizontal positioning) or perpendicular to the ground (e.g., vertical positioning).

Figure 2:
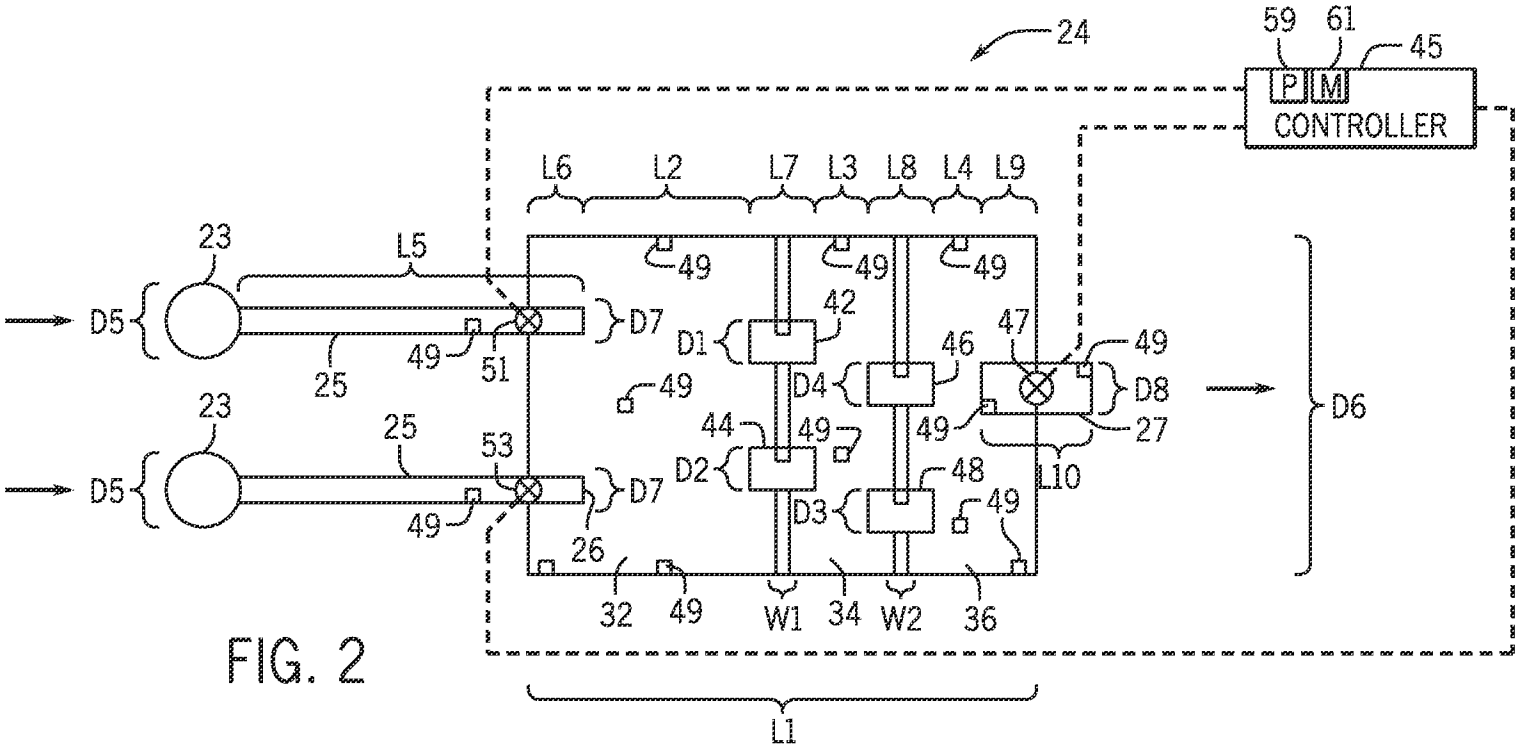
FIG. 2 is a block diagram of an embodiment of a the tuned exhaust system of FIG. 1 communicatively coupled to a controller.

Referring now to FIG. 2, the figure shows a block diagram of an embodiment of the tuned exhaust system 24 including two exhaust inlets 23 fluidly coupled to two exhaust pipes 25. As mentioned above, gases may exit the engine system 10 through the pipes 22 into the inlets 23 and the pipes 25 of the tuned exhaust 24, and into an exhaust compartment (e.g., shell) 30. The exhaust shell 30 may be divided into partitions (e.g. compartments) 32, 34, and 36 by positioning baffle plates 38 and 40 along a length L1 of the exhaust shell 30. For example, the plate 38 may be positioned at approximately half of the length L1±5%, 10%, 15%, 20%. The plate 40 may be positioned at approximately ¾ of the length L1±10%, 15%, 20%. Indeed, by positioning the baffle plates 38 and 40 along desired locations on the exhaust shell 30, the chambers 32, 34 and 36 may be provided at lengths L2, L3, and L4 respectively. The baffle plates may be metal plates having a plurality of openings or holes suitable for enabling the passage of gases through the baffle plates 32, 34, and 36 from the chamber 32 into the chamber 34 and then into the chamber 36. The depicted embodiment also illustrates the placement of perforated pipes 42, 44, 46, and 48. The pipes 42, 44, 46, and 48 may be perforated about their body to further enable gas flow into and out of the pipes 42, 44, 46, and 48. The pipes 42, 44, 46, and 48 may include diameters D1, D2, D3, and D4, respectively.

As mentioned above, exhaust gases from the cylinders 12 may enter through the inlets 23, traverse the pipes 25 having a length L5, exit through outlets 26 and enter the first chamber 32. The first chamber 32 may not sufficiently dampen noise, spurious pressure excursions, and/or pulsations to the shell 30. Accordingly, the pipes 42 and 44 enable a flow of the exhaust gases into the second chamber 34. The flow pipes 42 and 44 may be positioned such that some particulate and/or fluids may contact the baffle 38 and collect in a lower portion of the chamber 32. The collected particulate and/or fluids may then be removed, for example, by using a drain line. After the exhaust passes through the flow pipes 42 and 44, and a small portion of gas through the baffle 38 and into the second chamber 34, the exhaust gases may then exit the second volume chamber 34 into the third volume chamber 36 through the flow pipes 46 and 48. The exhaust gases may then exit the third volume chamber 36 and out to ambient surroundings via the exhaust stack 27.

In certain embodiments, as described in more detail below with respect to FIG. 3, a tuning process may be used, suitable for deriving desired sizes, positions, component numbers, and geometries of the tuned exhaust system 24. For example, a diameter D5 of the outlets 16, the diameters D1, D2, D3, and D4 of the pipes 42, 44, 46, and 48, a diameter D5 of the inlet 23, a diameter D6 of the shell 30, a diameter D7 of the pipes 22, and a diameter D8 of the exhaust stack 27 may be derived. Likewise, the length L1 for the chamber 30, the length L2, L3, and L4 for the chambers 32, 34, and 36, the length L5 for the pipes 25, an insertion length L6 of the pipes 25 into the chamber 30, a length L7 of the flow pipes 42, 44, a length L8 of the flow pipes 46, 48, an insertion length L9 of the exhaust stack into the chamber 30, and a length L10 of the exhaust stack 27 may be derived. Additionally, widths W1 and W2 of the baffle plates 38 and 40, respectively may be derived. Further, the number and placement of the pipes 25, 42, 44, 46, and 48, as well as the number of outlets 26, may be derived. Additionally, shapes and angles for all of the illustrated components (e.g., 23, 25, 26, 30, 42, 44, 46, 48, 50), such as conical, oblong, circular, square, triangular and so, on, may be derived.

FIG. 2 also depicts a controller 45 communicatively coupled to a restriction device (e.g., valve) 47 and to a plurality of sensors 49. The controller may include one or more processors 59 and a memory 61. The processors 59 may be used to execute non-transitory computer instructions stored in the memory 61, for example to modulate or drive the restriction device 47 during engine operations such that noise, scavenging, and/or pollution capture are improved. The sensors 49 may include temperature sensors, pressure sensors, flow sensors, sound sensors, and/or emission sensors (e.g., nitrogen oxides sensors, particulate count sensors, sulfur and sulfur oxides sensors, carbon oxides sensors). By restricting flow out of the stack 27, the controller 45 may dynamically tune the exhaust system 24 based on outflow of the engine system 10. In certain embodiments, in addition to or alternative to the valve 47, the controller 49 may be communicatively coupled to valves 51 and 53 to restrict flow of exhaust incoming from the conduits 25. Further details of the controller 45 are described below with respect to FIG. 7.

Figure 3:
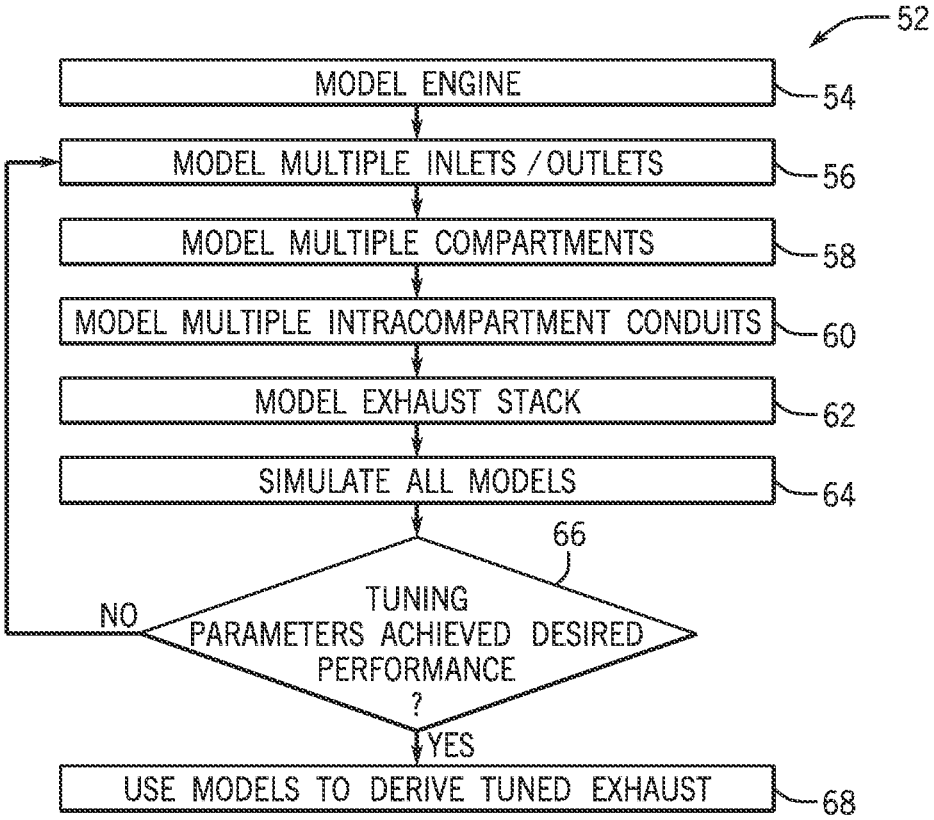
FIG. 3 is a flow chart of an embodiment of a process useful in tuning the tuned exhaust system of FIG. 2.

Turning now to FIG. 3, the figure depicts and embodiment of a process 52 suitable for deriving the desired sizes, positions, component numbers, and geometries for all components of the tuned exhaust system 24 shown in FIG. 2. The process 52 may be executed by a computing device, such as a computer, laptop, server, workstation, and/or table, and may include non-transitory computer instructions stored in a machine readable medium, such as a memory of the computing device. The process 52 may model (block 54) an engine, such as the internal combustion engine 10 shown in FIG. 1. In one embodiment, the engine modeling (block 52) may include creating one or more physics-based models of the combustion engine 10, such as a thermodynamic models, computer fluid dynamics (CFD) models, finite element analysis (FEA) models, and so on. The physics-based model(s) may then be used to derive a set of operating parameters for the engine 10, including exhaust flows, pressures, temperatures, mass flow volumes, and the like. In one embodiment, a modeling software package, such as Optimum Power Virtual Engines (VE) available from Optimum Power Technologies of Bridgeville, Pa. may be used to model the engine 10 and/or the tuned exhaust 24. The tuned exhaust system 24 may be modeled by, for example, modeling the subcomponents of the tuned exhaust system, such as by modeling (block 56) one or more inlets 16/outlets 19, modeling (block 58) one or more of the compartments 32, 34, 36, modeling (block 60) one or more intracompartment conduits or pipes 42, 44, 46, 48, and modeling (block 62) the exhaust stack 50, and modeling the baffle plates 38 and 40.

The modeling (block 54) of the engine 10 may include modeling the number of strokes (e.g., 2, 3, 4, 5 strokes), modeling the RPM range (e.g., 100-500, 100-750 RPM, 100-1000 RPM), modeling the fuel type (e.g., diesel, gasoline, natural gas), engine components (e.g., turbochargers, superchargers, transfer ports, reed valves, rotary valves, power valves, crankcases, actuators, valves, intercoolers, manifolds, cylinders, channels, plenums, pipes), parametric design modeling (e.g., bore-stroke ratios, compression ratios, power output/displacement ratios), and/or defining optimization criteria (e.g., mathematical constraints associated with engine component lengths, widths, diameters, geometries).

The modeling (block 56) of the inlets 16 and/or outlets 19 may include modeling one or more diameters D5 of the inlet 23, one or more diameters D7 of the outlet 26, and/or modeling one or more diameter ratios (e.g., D5 to D7 also referred to as inlet to outlet ratio) between the inlet 23 and the outlet 26 of approximately 1 to 1, 1 to 1.25, 1 to 2, 1 to 2.25, 1 to 2.5. The modeling (block 56) may additionally or alternatively include modeling various lengths L5 for the pipe 25, as well as geometry of the pipe 25 (e.g., conical, square, triangular).

The modeling (block 58) of the multiple compartments 30, 32, 34, and 36 may include modeling compartment sizes (e.g., lengths L1, L2, L3, L4, diameter D6) to derive the tuned exhaust 24 suitable for minimizing noise and substantially reducing undesired emissions (e.g., NOx, sulfur). Thicknesses for walls of the compartments 30, 32, 34, and 36 may also be modeled. Likewise, placement and thickness (e.g., W1, W2) of the baffle plates 38 and 40 inside of compartment 30 may be modeled. Material types (e.g., steel, chromoly, inconel, titanium, aluminum, ceramics) may also be modeled to determine lifecycle for the tuned exhaust 24 as well as to determine material combinations that may improve noise reduction, reduce particulate emissions, and increase the life for the tuned exhaust 24.

The modeling (block 60) of the multiple intercompartment conduits (e.g., conduits 42, 44, 46, 48) may include modeling lengths L7 and L8, as well as diameters D1, D2, D3, and D4 to derive desired wave dynamics and reduction of acoustic noise and vibration for the tuned exhaust 24. Indeed, the process 52 may additionally use wave dynamic modeling in blocks 54, 56, 58, 60, 62 and 64 to derive an acoustically tuned exhaust 24 that may enable improved scavenging, noise reduction, and capture of certain undesired emissions. The geometries (e.g., cylindrical, conical, triangular, square) of the conduits 42, 44, 46, 48, the placement in the compartment 30 of each of the conduits 42, 44, 46, 48, as well as the materials used, may be modeled (block 60). Additionally, the number of conduits (e.g., 1, 2, 3, 4, or more) placed inside of the compartment 30 may be derived. Similarly, the location of the conduits 42, 44, 46, 48 with respect to the baffles 38 and 40 may be modeled.

The modeling (block 62) of the stack 27 may include modeling the lengths L9 and L10, and the diameter D8 so as to increase noise reduction and improve the flow of exhaust to the atmosphere. The modeling (block 62) may additionally include modeling features of the stack 27, such as geometric shape (cylindrical, conical, square, triangular), and/or materials used (e.g., steel, chromoly, inconel, aluminum, ceramics) to construct the stack 27. Additionally, placement and use of any catalytic structures in the chambers 30, 32, 34, 36, conduits 42, 44, 46, 48, and/or stack 27, may be modeled by the process 52.

The models may be simulated (block 64) to derive wave dynamics, scavenging behavior, thermodynamic behavior, acoustic behavior, particulate counts and capture of particulates, fluid flows, or a combination thereof, of the engine 10 and the tuned exhaust 24. Accordingly, if the process 52 determines (decision 66) that the models achieved a desired performance, such as a desired flow of exhaust fluids, scavenging, engine 10 efficiency, engine 10 and exhaust 24, thermodynamics, engine 10 fuel usage, noise, particulate emission counts, or a combination thereof, then the process 52 may use the models (block 68) to derive the tuned exhaust 24 having the desired features, as described in more detail below with respect to FIG. 4. Otherwise, the process 52 may iterate to block 56 and build a new set of models. By iteratively modeling and simulating the engine 10 and features for the tuned exhaust 24, the systems and methods described herein may provide for lower noise, increased flows, and lower emissions through the tuned exhaust 24.

Figure 4:
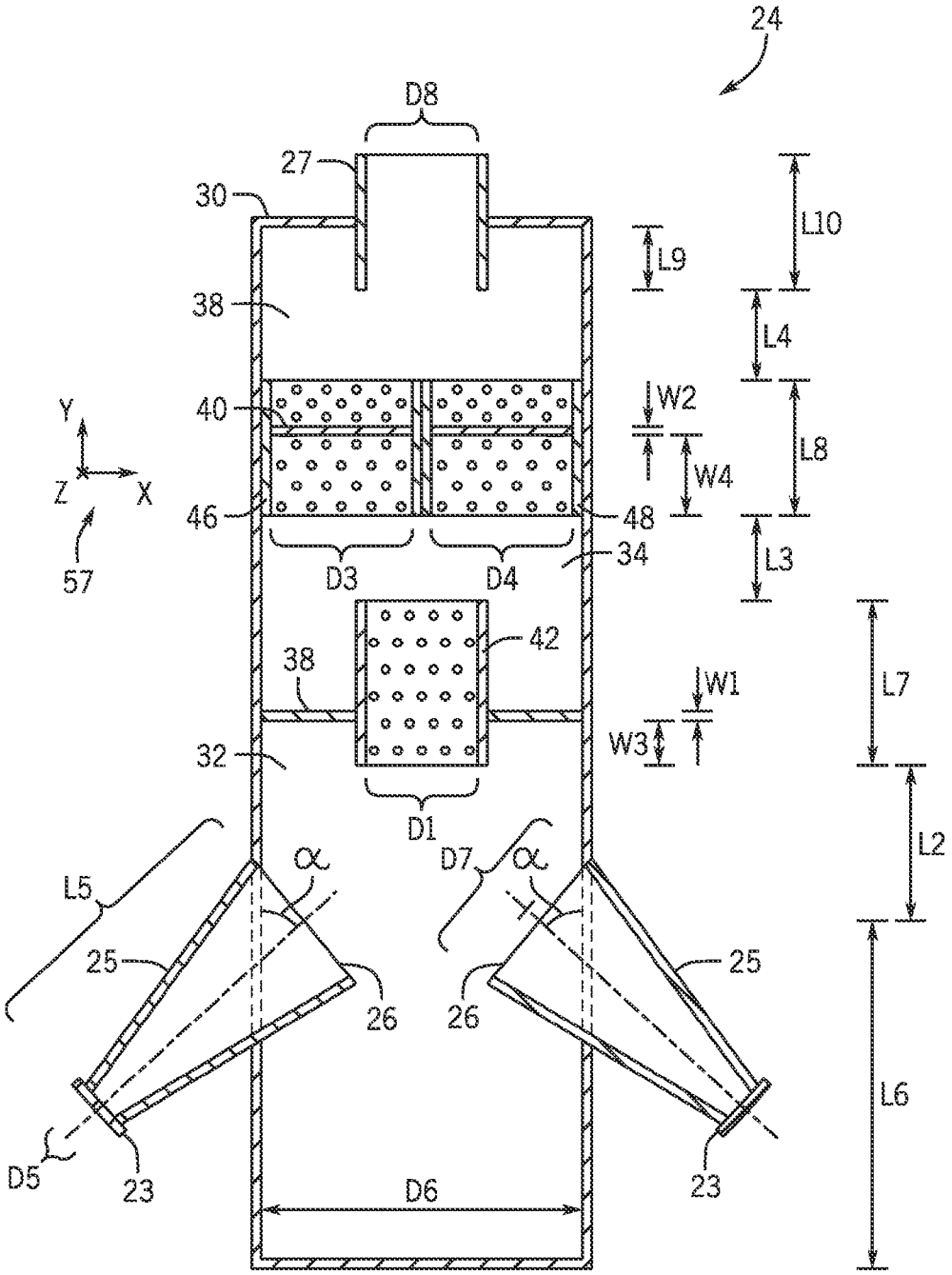
FIG. 4 is a cross sectional view of an embodiment of the tuned exhaust system of FIG. 2.

FIG. 4 is a cross-section view on an X-Y plane of axes 57 of an embodiment of the tuned exhaust 24 including certain features useful in the reduction of noise, the improvement of fluid flows, and the reduction of undesired particulates released to the atmosphere. The tuned exhaust 24 may have been derived, for example, by using the process 52 as described in FIG. 3. In the depicted embodiment, the tuned exhaust 24 receives exhaust gas through the inlets 23. The inlets 23 may include a diameter D5 of approximately 8 inches interior diameter (ID)±4 inches. The exhaust gas may then flow through the pipes 25 and exit through the outlet 26. In the depicted embodiment the outlet 26 may include an ID D7 of approximately 19 inches±8 inches. The ratio of D5 to D7 may be of approximately between 1:1 to 1:4.

Each of the two-depicted pipes 25 may be disposed at an angle alpha ($\alpha$) of approximately 45 degrees±15 degrees with respect to side walls of the chamber 32. Once inside of the chamber of shell 30, the exhaust may produce certain wave dynamics, as modeled above with respect t FIG. 3. The chamber 30 may include the length L1 of approximately 197 inches±50 inches, and the diameter D6 of approximately 25 inches±15 inches ID. The exhaust may then traverse the compartment 32 via the conduit 42. The conduit 42 may be disposed in the approximately center of the chamber 30 and maybe attached to baffle plate 38. The baffle plate 38 may include the width W1 of approximately 1 inch±1 inch. The conduit 42 may include the length of approximately 41 inches±10 inches. A lower portion of the conduit 42 may traverse the baffle plate 38 about a width W3 of approximately 4 inches±4 inches. The conduit 42 may protrude into the chamber 32 and the chamber 34 at a protrusion ratio of between 1 to 1 and 1 to 5. That is for every inch of protrusion into the chamber 32, the conduit 42 may protrude between 1 and 5 inches into the chamber 34, or vice versa.

The length L2 of the chamber 32 maybe of approximately 35 inches±10 inches, and the length L6 may be of approximately 48 inches±12 inches. Some of the exhaust gas may traverse the conduct 42 into the chamber 34 having the length L3 of approximately 17 inches±10 inches. The exhaust gas may then traverse the conduits 46 and 48 having the length L8 of approximately 38 inches±12 inches. As depicted the baffle plates 40 may be positioned so as to aid in securing the conduits 46 and 48 to the shell 30. The positioning of the baffle plates may result in a width W4 of approximately 25 inches±10 inches. The diameter D3 and D4 of the conduits 46 and 48 respectively, may be of approximately 12 inches±5 inches ID. Likewise, the diameter D1 of the conduit 42 may be of approximately 12 inches±5 inches ID. In the depicted embodiment, the conduits 42, 46, and 48 may be constructed out of perforated pipe having walls with a thickness of approximately 0.25 inches±0.5 inches. The exhaust gases may then proceed from the chamber 36 having the length L4 of approximately 5 inches±2 inches into the exhaust stack 27. The exhaust stack 27 may include the length L10 of approximately 42 inches±12 inches and may be disposed inside of the shell 30 at a length L9 of approximately 13 inches±10 inches. The exhaust gases may then exit the stack 27 into the atmosphere. By providing for the tuned exhaust 24 having the depicted lengths diameters and geometries, the system and methods described herein may provide for a more efficient exhaust of fluid (e.g. gases) exiting the engine system 10, minimize noise, and increase scavenging and subsequent engine 10 efficiency.

Figure 5:
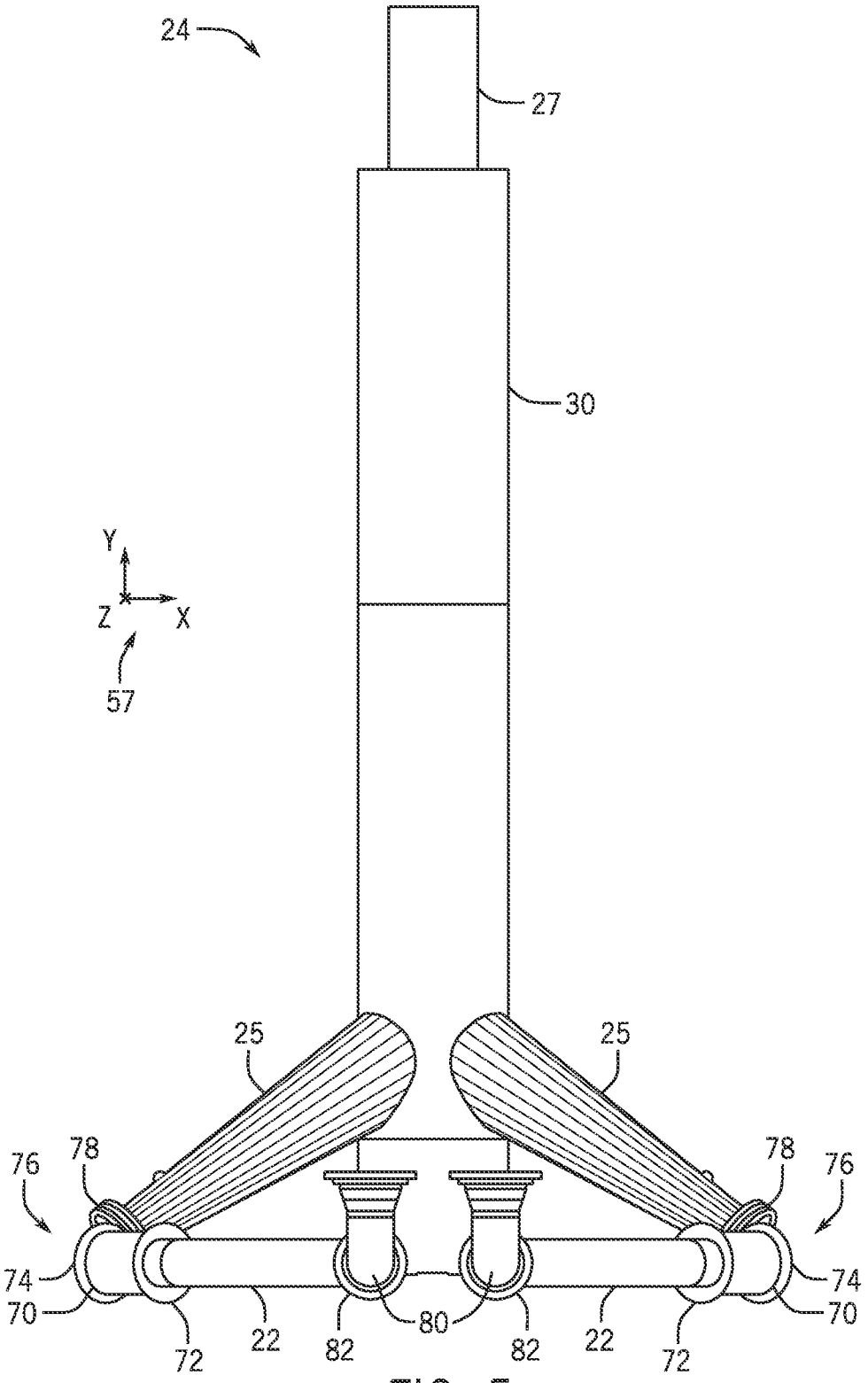
FIG. 5 is a perspective side view of an embodiment of a vertically positionable tuned exhaust system.

FIG. 5 is a perspective view of an embodiment of the tuned exhaust 24 taken along the X-Y plane of the axes 57. In the depicted embodiment, the tuned exhaust system 24 is illustrated as a vertically positionable tuned exhaust system 24. It is to be noted that in other embodiments, the tuned exhaust system 24 maybe horizontally positionable. The pipes 25 of the tuned exhaust 24 may be fluidly coupled to the pipes 22 of the engine 10 by using couplings 70 (e.g., pipes, heat exchangers). As illustrated, the coupling 70 may include flanges 72 suitable for connecting the pipes 22 to the pipes 25. Likewise, flanges 74 maybe used to connect the pipe coupler 70 to an elbow joint 76. Flanges 78 may then be used to couple the elbow joint 76 to the pipes 25 of the tuned exhaust system 24. On the engine side, the pipes 22 maybe coupled to engine couplers or exhaust couplers 80 by using flanges 82. Accordingly, exhaust from the engine 10 may enter the couples 80, traverse through pipe 22 into the tuned exhaust pipe 25, and into the shell or chamber 30. As described above with respect to FIG. 4, the shell or chamber 30 may include a variety of components suitable for managing the wave dynamics created by the exhaust flow, thus reducing noise, increasing engine efficiency, and improving the scavenging of the engine system 10. The exhaust will then flow out through the exhaust stack 27 and into the atmosphere.

Figure 6:
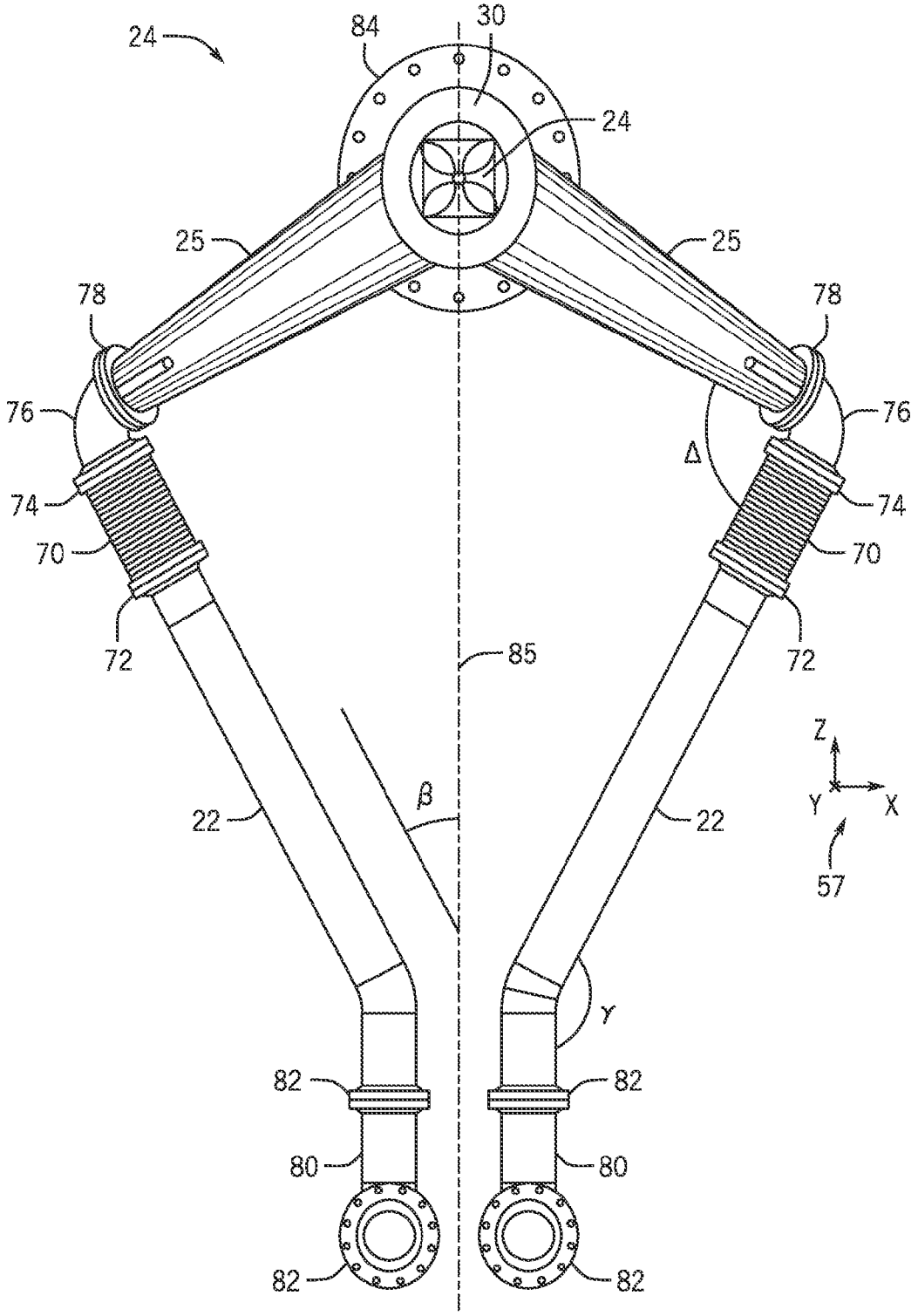
FIG. 6 is a perspective top view of an embodiment of a vertically positionable tuned exhaust system of FIG. 5.

Turning now to FIG. 6, the figure illustrates a top view of the exhaust system 24 taken along the X-Z plane of the axes 57. As mentioned above, exhaust leaving the engine 10 may enter through the element 82 traverse the pipe 22 the coupler 70, the elbow joint 76, and into the pipes 25 of the tuned exhaust system 24. Also depicted are the flanges 82 suitable for coupling the element 80 to the pipes 22, the flanges 72, suitable for coupling the pipes 22 to the elements 70, the flanges 74 suitable for coupling the coupler 70 to the elbow pipes 76, and the flanges 78 suitable for coupling the elbow 76 to the pipes 25. Also shown is a flange 84 suitable for attaching the shell 30 to a variety of bases such as metal plate bases concrete and the like. The figure also illustrates the exhaust stack 27 suitable for providing a conduit to transfer the engine 10 exhaust into the atmosphere.

In the depicted embodiment, the pipes 22 are disposed at an angle β of approximately between 15° and 60° with respect to the axis 85. Additionally, the pipes 25 and the coupler 70 may be disposed at an angle Δ. The components of the tuned exhaust system 24 may be manufactured of steel, stainless steel, chromoly, titanium, aluminum, inconel, ceramics, and the like, suitable for exposure to hot gases. The components may be molded, machined, milled, or otherwise formed into the desired geometries described. By using the various components and geometries illustrated in FIGS. 2, 4, 5, and 6, the system and methods described herein may enable more efficient flow of exhaust, thus improving the reduction of noise and increasing the life and the efficiency of the engine 10.

Figure 7:
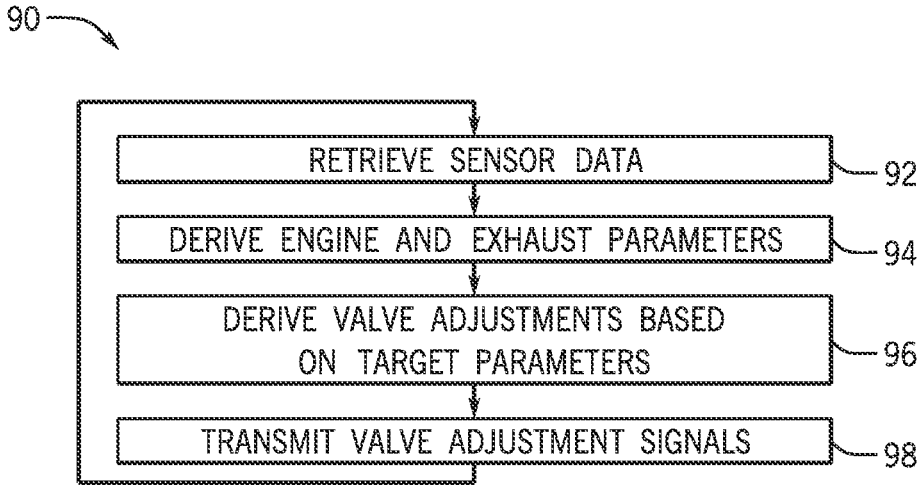
FIG. 7 is a flow chart of an embodiment of a process useful in controlling the tuned exhaust system of FIGS. 1 and 2.

FIG. 7 depicts an embodiment of a process 90 suitable for controlling the valves 47, 51, and/or 53. By controlling the valves 47, 51, and/or 53, the techniques described herein may dynamically reconfigure the tuned exhaust system 24 to more efficiently provide for noise reduction, exhaust flow through the engine system 10, and improved scavenging. The process 90 may be implemented by using non-transitory computer readable instructions or code stored in memory of the controller 45 and executed by the controller 45.

In the depicted embodiment, the process 90 may retrieve (block 92) sensor 49 data. As mentioned above with respect to FIG. 2, the sensor data may include temperature data, pressure data, flow data, sound data, and/or emission data (e.g., nitrogen oxides data, particulate count data, sulfur and sulfur oxides data, carbon oxides data). The data may be retrieved from various locations along the pipes 25, the chambers 32, 34, 36, the pipes 42, 44, 46, 48, and/or the stack 27. The data may additionally include engine system 10 data, such as RPM, piston cycle data, fuel flow, fuel type, and the like.

The process 90 may use the sensor data to derive (block 94) engine 10 and/or exhaust system 24 parameters. For example, physics based models (e.g., thermodynamic models, wave dynamic models, computer fluid dynamic models, finite element analysis models), statistical models, and/or heuristic models (e.g., artificial intelligence models, neural network models, genetic algorithm models) may be used to derive current charging efficiency, scavenging efficiency, trapping efficiency, air to fuel ratios, and/or average trapped equivalence ratio. The process 90 may then derive (block 96) valve adjustments that may result in certain targets, such as targeted charging efficiency, scavenging efficiency, trapping efficiency, air to fuel ratios, and/or average trapped equivalence ratio. The process 90 may then transmit (block 98) valve adjustment signals to modulate or otherwise change valve positions. The process 90 may be cyclical and then iterate to block 92. By sensing (block 92) system 10 and 24 data, deriving (block 94) certain parameters, deriving (block 96)

adjustments, and transmitting (block 98) adjustments to the valves 47, 51, and/or 53, the exhaust system 24 may be tuned dynamically based on sensed conditions, thus improving engine 10 efficiency.

While the preferred embodiments of the present invention have been shown in the accompanying figures and described above, it is not intended that these be taken to limit the scope of the present invention and modifications thereof can be made by one skilled in the art without departing from the spirit of the present invention.

What is claimed is:

1. A system, comprising:

an exhaust system, comprising:

a first and a second conduit configured to receive an exhaust from an engine having at least two cylinders;

a first chamber configured to receive the exhaust from the first and the second conduits;

a second chamber downstream of the first chamber and fluidly coupled to the first chamber by using a third conduit;

a third chamber downstream of the second chamber and fluidly coupled to the second chamber by using a fourth and a fifth conduit;

an exhaust stack downstream of the third chamber and fluidly coupled to the third chamber;

an exhaust flow path through the first and second conduits, the first chamber, the third conduit, the second chamber, the fourth and fifth conduits, the third chamber, and the exhaust stack;

at least one valve coupled to the exhaust flow path; and a controller communicatively coupled to the at least one valve, wherein the controller is configured to adjust the at least one valve to dynamically tune the exhaust system.

2. The system of claim 1, wherein the first conduit comprises an inlet to outlet diameter ratio of approximately between 1 to 2.5.

3. The system of claim 1, wherein the first conduit, the second conduit, or both, are directly angled with respect to side walls of the first chamber at an angle of between 30 to 60 degrees.

4. The system of claim 1, wherein the third conduit is disposed approximately concentrically with respect to the first and the second chambers.

5. The system of claim 4, wherein the third conduit protrudes into the first chamber and into the second chamber at a protrusion ratio of between 1 to 1 and 1 to 5.

6. The system of claim 1, wherein the fourth and the fifth conduit are disposed side by side and abutting each other.

7. The system of claim 6, wherein an outside diameter (OD) of each of the fourth and the fifth conduit is approximately half of an inside diameter (ID) of either of the second or the third chambers.

8. The system of claim 1, wherein the at least one valve comprises a valve disposed inside the exhaust stack.

9. The system of claim 1, wherein the at least one valve comprises a first valve disposed inside of the first conduit and a second valve disposed inside of the second conduit.

10. An exhaust system, comprising:

a compartment;

a first and second plate disposed inside the compartment and defining a first, a second, and a third partition of the compartment disposed sequentially one after another in a downstream direction along an axis of the compartment;

a first and a second conduit fluidly coupled to the first partition and configured to receive an exhaust from an engine having at least two cylinders, wherein the first and second conduits are acutely angled in the downstream direction relative to side walls of the compartment, wherein the second partition is disposed downstream of the first partition and is fluidly coupled to the first partition with a third conduit, and the third partition is disposed downstream of the second partition and is fluidly coupled to the second partition with a fourth conduit.

11. The system of claim 10, comprising a first exhaust pipe having a first inlet fluidly coupled to the engine and a first outlet fluidly coupled to the first conduit; and a second exhaust pipe having a second inlet fluidly coupled to the engine and a second outlet fluidly coupled to the second conduit, wherein both the first and the second exhaust pipes are disposed at an angle of approximately between 15 to 60 degrees with respect to the first compartment.

12. The system of claim 10, wherein the first plate is disposed at approximately between half a length of the compartment ±20%.

13. The system of claim 10, wherein the second plate is disposed at approximately between ¾ of a length of the compartment ±20%.

14. The system of claim 10, wherein the third conduit comprises a perforated pipe.

15. The system of claim 10, wherein the third conduit protrudes into the first partition and into the second partition at a protrusion ratio of between 1 to 1 and 1 to 5.

16. The system of claim 10, comprising:

an exhaust flow path through the first and second conduits, the first partition, the third conduit, the second partition, the fourth conduit, and the third partition;

at least one valve coupled to the exhaust flow path; and a controller communicatively coupled to the at least one valve, wherein the controller is configured to adjust the at least one valve to dynamically tune the exhaust system.

17. A system, comprising:

an exhaust system, comprising:

a first conduit configured to receive an exhaust from an engine;

a first chamber configured to receive the exhaust from the first conduit;

a second chamber downstream of the first chamber and fluidly coupled to the first chamber with a second conduit;

a third chamber downstream of the second chamber and fluidly coupled to the second chamber with a third conduit; and an exhaust outlet downstream of the third chamber and fluidly coupled to the third chamber;

an exhaust flow path through the first conduit, the first chamber, the second conduit, the second chamber, the third conduit, the third chamber, and the exhaust outlet;

at least one valve coupled to the exhaust flow path; and a controller communicatively coupled to the at least one valve, wherein the controller is configured to adjust the at least one valve to dynamically tune the exhaust system.

18. The system of claim 17, comprising the engine, wherein the engine is configured to operate at a range of between 100 and 1000 revolutions per minute.

19. The system of claim 17, wherein the first conduit comprises an inlet to outlet diameter ratio of approximately between 1 to 2.5.

20. The system of claim 17, wherein the at least one valve comprises at least one upstream valve disposed upstream of the second chamber and at least one downstream valve disposed downstream of the second chamber.

21. The system of claim 1, wherein the exhaust system comprises at least one sensor configured to measure an operational parameter, and the controller is configured to adjust the at least one valve based on feedback from the at least one sensor to dynamically tune the exhaust system.

22. The system of claim 16, comprising at least one sensor configured to measure an operational parameter, and the controller is configured to adjust the at least one valve based on feedback from the at least one sensor to dynamically tune the exhaust system.

23. The system of claim 17, wherein the exhaust system comprises at least one sensor configured to measure an operational parameter, and the controller is configured to adjust the at least one valve based on feedback from the at least one sensor to dynamically tune the exhaust system.

* * * * *